US005198140A

United States Patent [19]

Joshi et al.

[11] Patent Number: 5,198,140

[45] Date of Patent: Mar. 30, 1993

[54] DUAL COMPOSITION SOAP OR DETERGENT BAR CONTAINING CONVOLUTED SURFACES AND TONGUE AND GROOVE INTERLOCK

[75] Inventors: David Joshi, Plainfield, N.J.; Jose Sanabria, Cali, Guatemala

[73] Assignee: Colgate-Palmolive Company, New York, N.Y.

[21] Appl. No.: 668,752

[22] Filed: Mar. 13, 1991

Related U.S. Application Data

[63] Continuation of Ser. No. 265,989, Nov. 2, 1988, abandoned.

[51] Int. Cl.[5] ..... C11D 17/00

[52] U.S. Cl. ..... 252/90; 252/92; 252/174; 252/134; 252/368; 252/DIG. 16

[58] Field of Search ..... 252/90, 92, 134, 174, 252/368, DIG. 16

[56] References Cited

U.S. PATENT DOCUMENTS

| | | | |
|---|---|---|---|
| 3,601 | 1/1891 | Scott | 252/134 |
| D. 24,506 | 7/1895 | Webb | D28/8.1 |
| D. 206,140 | 11/1966 | Meeker | D28/8.1 |
| D. 213,074 | 12/1968 | Griffith et al. | D28/8.1 |
| 1,083,571 | 1/1914 | Waltke | 252/90 |
| 2,250,318 | 7/1941 | Wallace, Jr. | 252/134 |
| 3,294,692 | 12/1966 | Kelly et al. | 252/134 |
| 3,884,605 | 5/1975 | Grelon | 425/131.1 |
| 3,923,438 | 12/1975 | Perla | 425/131.1 |
| 3,925,225 | 12/1975 | Morrison | 252/90 |
| 4,094,946 | 6/1978 | Finkensiep et al. | 264/171 |
| 4,203,857 | 5/1980 | Dugan | 252/92 |
| 4,224,266 | 9/1980 | Hunt et al. | 264/75 |
| 4,683,072 | 7/1987 | Holdt et al. | 252/102 |
| 4,746,452 | 5/1988 | Marek | 252/134 |
| 4,996,000 | 2/1991 | Redeker | 252/90 |

*Primary Examiner*—Paul Lieberman
*Assistant Examiner*—Bradley A. Swope
*Attorney, Agent, or Firm*—Richard J. Ancel; Robert C. Sullivan

[57] ABSTRACT

This invention relates to a dual composition bar and extrusion nozzle therefore. The bar is formed of two different materials, preferably of separate colors, and has substantially sinusoidal upper and lower surfaces with a tongue and groove interlock therebetween. The extrusion nozzle utilizes two dies, the first of which has two die portions separated by a die element for forming a tongue and groove interlock between the two materials. The die element does not extend to the second die wherein the convoluted die portions squeeze the two materials together enhancing the interlock.

2 Claims, 4 Drawing Sheets

DUAL COMPOSITION SOAP OR DETERGENT BAR CONTAINING CONVOLUTED SURFACES AND TONGUE AND GROOVE INTERLOCK

This application is a continuation of application Ser. No. 07/265,989 filed Nov. 2, 1988, now abandoned.

BACKGROUND OF THE INVENTION

1. Field of the Invention

This invention relates to a dual composition soap or detergent bar made from two diverse materials and to an extrusion nozzle for use in the manufacture thereof.

2. Description of the Prior Art

The U.S. patent to Friedhelm Finkensiep et al, U.S. Pat. No. 4,094,946, issued Jun. 13, 1978, for "Striped Soap, Its Production and Apparatus for Its Production," discloses a method and plodder for the production of two color striped pieces of soap or detergent by continuously extruding two strands of colored soap. In this arrangement, the strands are concentric. The two strands of colored soap are passed through a die to form a single strand of parallel stripes.

In the U.S. Pat. No. 3,884,605 to Pierre Grelon, issued May 20, 1975, for "Manufacture of Soap Bars," there is disclosed the manufacture of striped soap bars by simultaneously compressing two soap masses of different colors in parallel directions using a twin barreled plodder which has a partition wall between the augers. An extrusion cone is employed using separate extrusion plates.

In U.S. Pat. No. 4,224,266 to Leslie Hunt et al, issued Sep. 23, 1980, for "Manufacture of Detergent Bars," there is disclosed a single screw plodder for forming a two color bar with a partition in the extrusion cone.

The U.S. Pat. No. 4,203,857, to Bernard B. Dugan, issued May 20, 1980, for "Detergent Scrubber Article and Method for Manufacture" sets forth a detergent-scrubber article wherein two different materials are adhesively bonded together.

Extrusion cones for striated soaps and multi-colored soaps or detergents for use in laundry or personal care are disclosed in U.S. Pat. No. 3,294,692, issued Dec. 27, 1966 to W. A. Kelly et al for "Striped Soap Bars and Method and Apparatus for Making the Same" and U.S. Pat. No. 3,923,438 to Giulio Perla, issued Dec. 2, 1975 for "Apparatus for Making Variegated Soap Base."

SUMMARY OF THE INVENTION

This invention relates to a dual composition soap or detergent bar wherein the bar is extruded and of two different materials which, preferably, are separately colored. The two different compositions are mechanically interlocked by a tongue and groove interlock, which interlock is enhanced during extrusion by the formation of a convoluted scrubbing surface on opposite faces of the bar.

The bar is formed by feeding two different paste compositions into a plodder having two barrels and then fed through an extrusion nozzle which forms the tongue and groove interlock between the two extruded bar portions. The extrusion nozzle is provided with dies for forming the tongue and groove interlock, as well as convoluted exterior surfaces which press the tongue and groove portions into the interlock position.

DETAILED DESCRIPTION OF THE INVENTION

Figure 1:
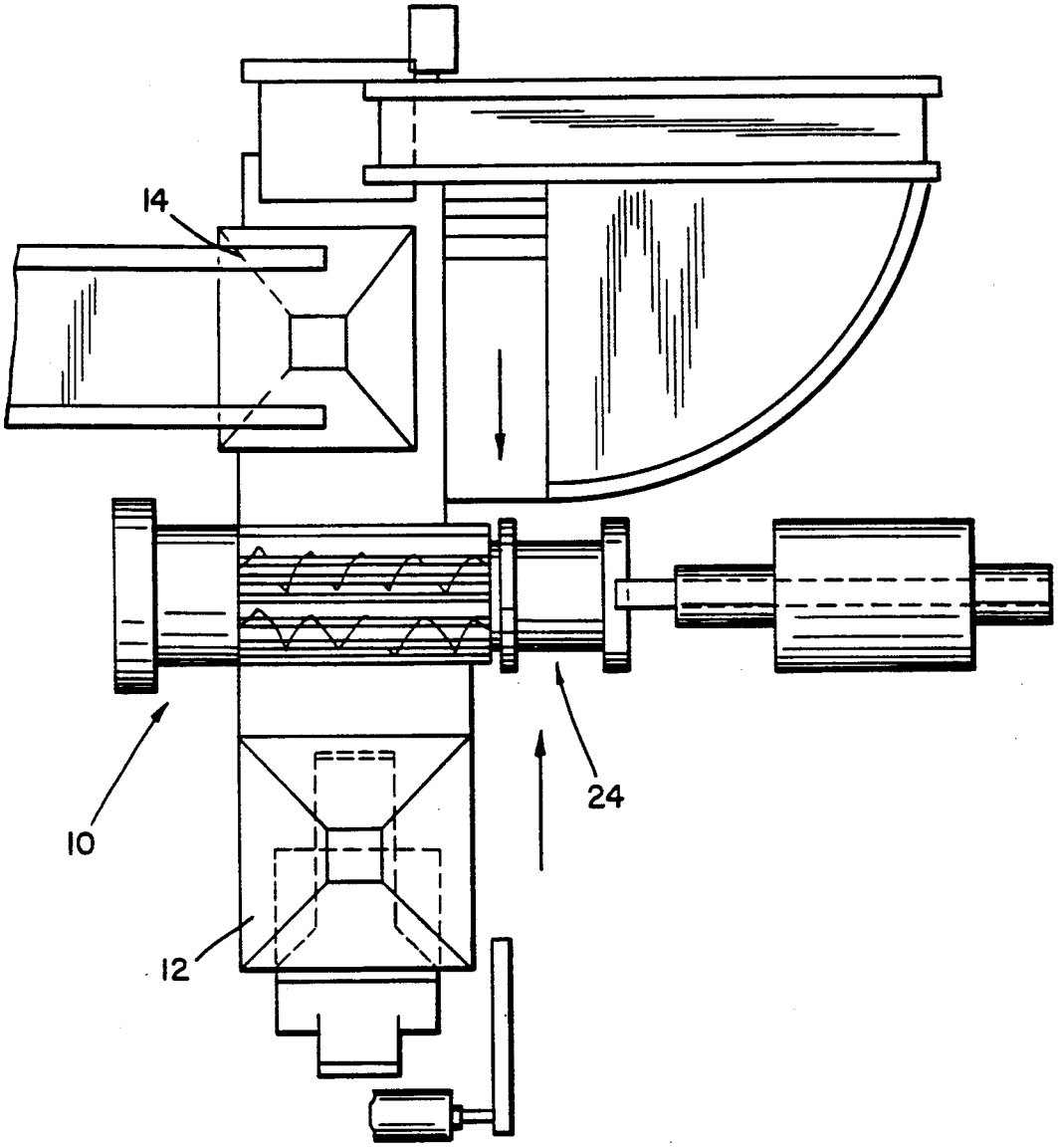
FIG. 1 is a schematic view of a plodder for forming the dual composition bar according to the present invention.

With continuing reference to the accompanying drawings, wherein like reference numerals designate similar parts throughout the various views, reference numeral 10 generally designates a Mazzoni plodder, generally similar to the plodder disclosed and described in U.S. Pat. No. 4,459,094.

The plodder 10 is adapted to facilitate the separate mixing and extrusion of two different paste materials, which are preferably of different colors. Paste material A is fed into the plodder by means of a feed conveyor 12 while paste material B is fed into the plodder 10 by way of the feed conveyor 14.

The plodder 10 has two barrels 16 and 18 in which screw augers 20 and 22 rotate to mix and deliver paste materials A and B, respectively, from the inlet to the barrels 16 and 18 to an extrusion nozzle 24. The barrels 16 and 18 are maintained separate by a partition 26 so that paste material A and paste material B are maintained separate until fed through the extrusion nozzle 24.

The extrusion nozzle 24 receives the two paste materials after mixing and plodding into spaces 30 and 32 from whence the pastes A and B are extruded first through a composite die 31 having die portions 33 and 34 which are convoluted to form substantially sinusoidal ridges and grooves in the extruded dual composition bar.

The die 31 is disposed in an extrusion housing 31*a* and has its die portions 33 and 34 separated by a die element provided with recess 40 and projections 42 for forming cooperating tongue and groove interlock in the dual composition bar when finally extruded.

Figure 2:
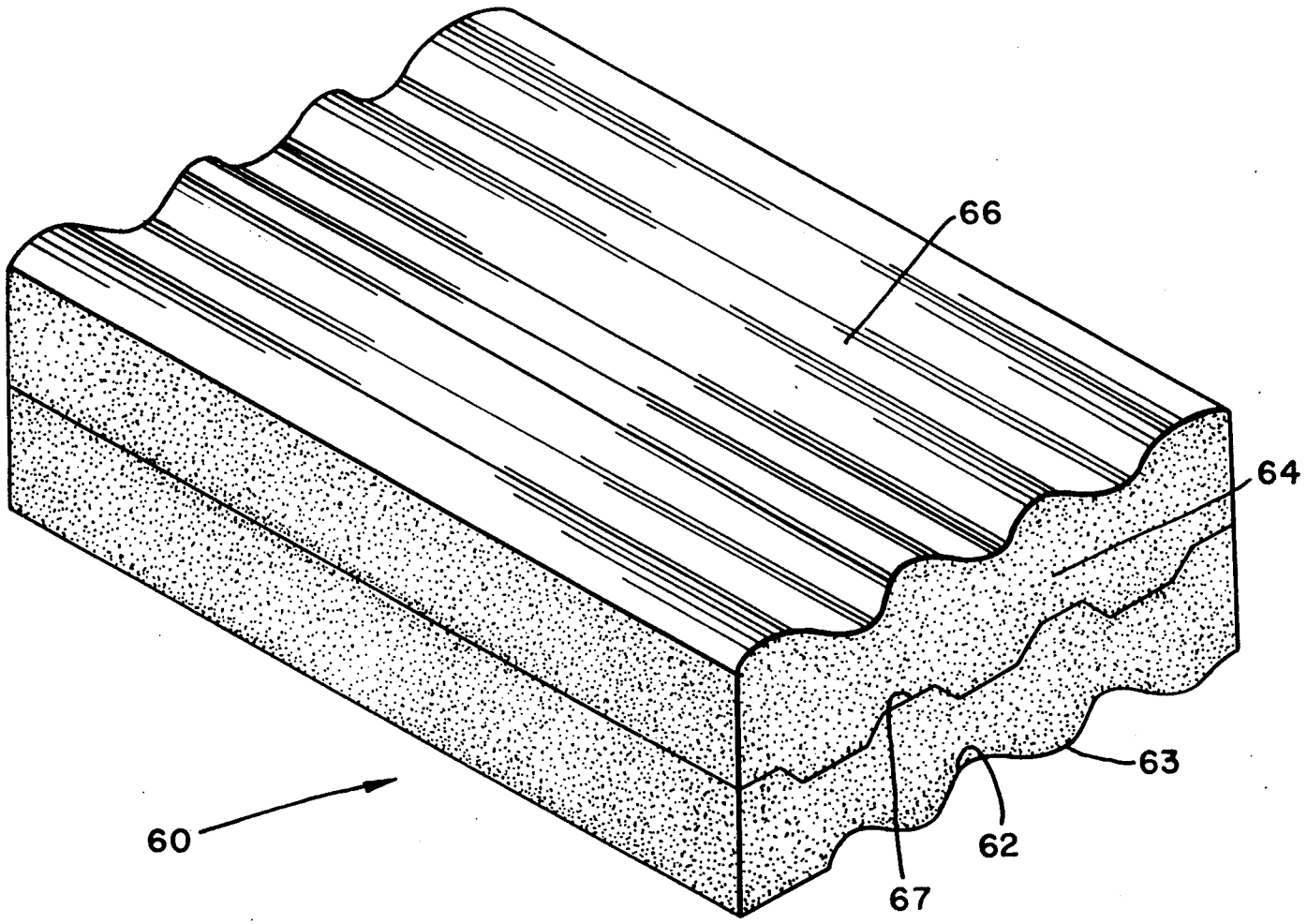
FIG. 2 is a perspective view of a dual composition bar according to the invention.
Figure 3:
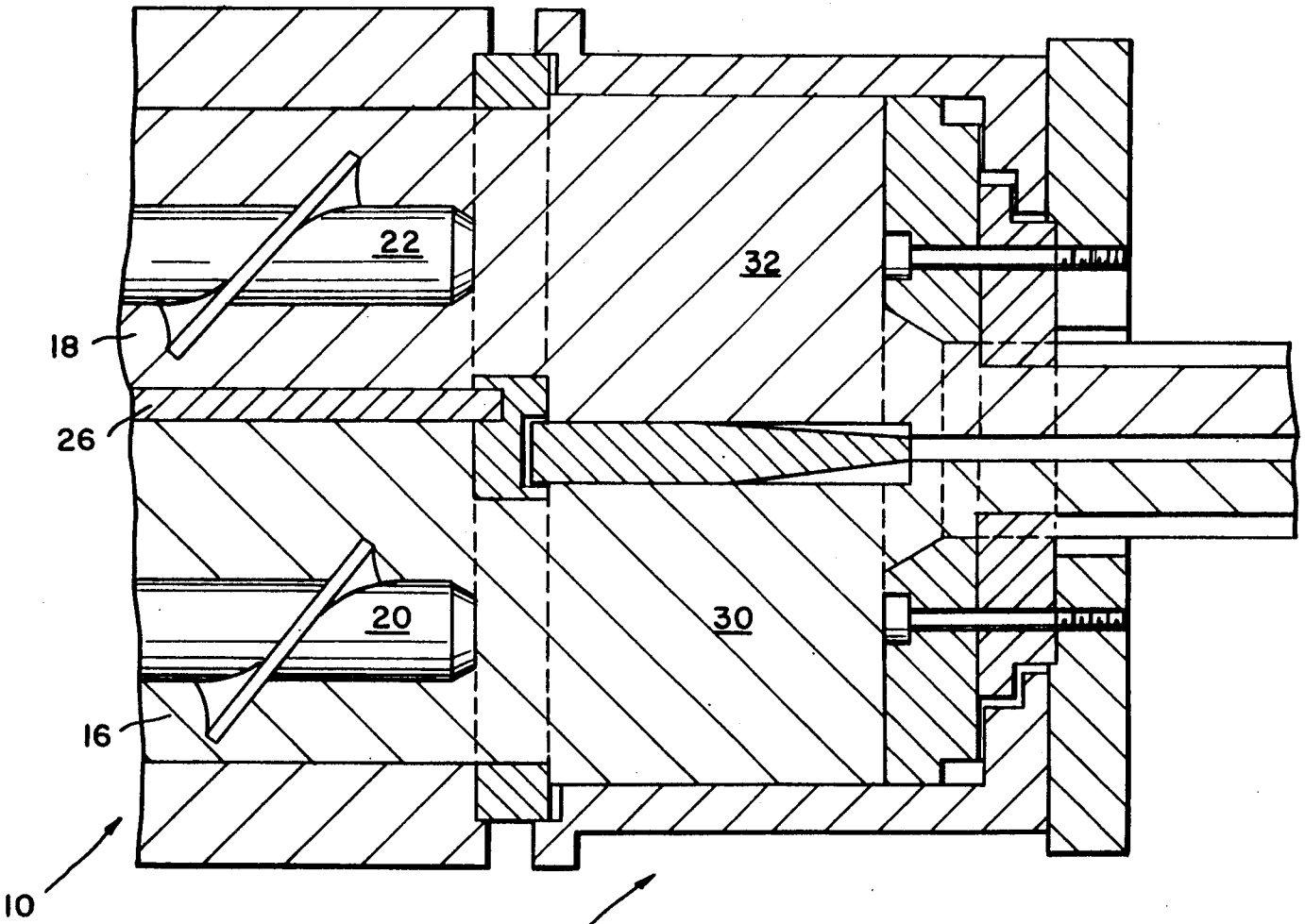
FIG. 3 is a vertical sectional view illustrating the extrusion nozzle according to the invention.
Figure 5:
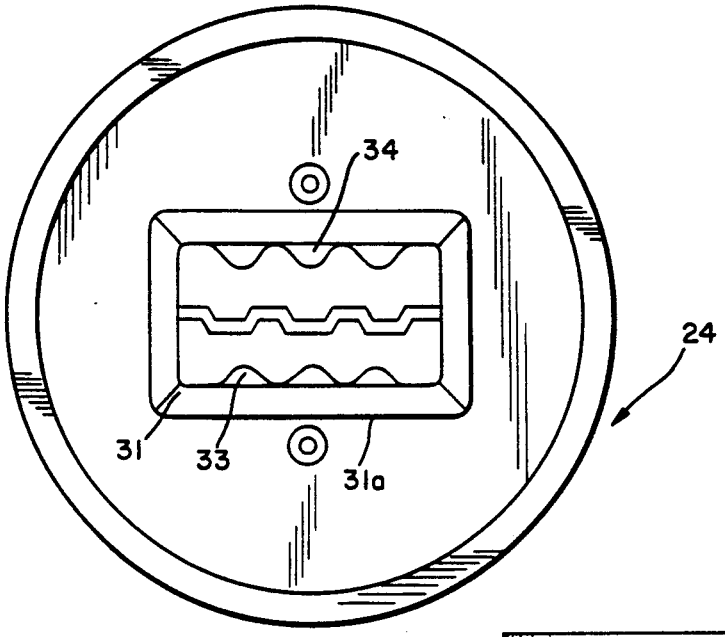
FIG. 5 is an inlet end elevational view of the extrusion nozzle.
Figure 4:
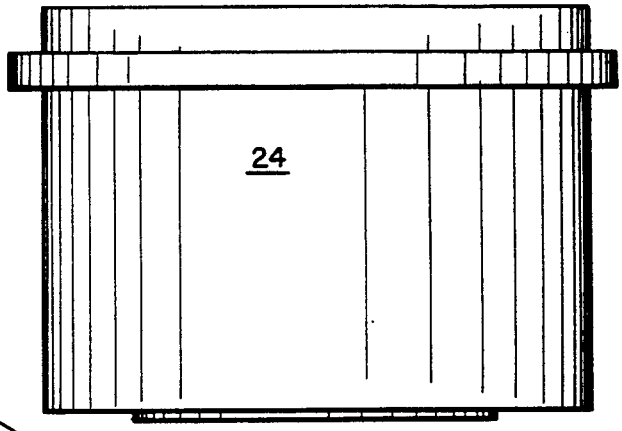
FIG. 4 is a side elevational view of the extrusion nozzle.
Figure 6:
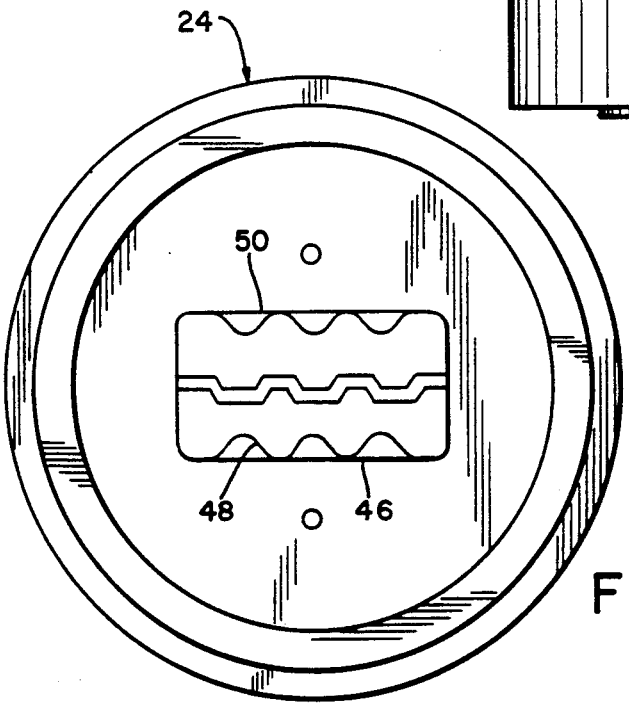
FIG. 6 is a delivery end elevational view of the extrusion nozzle.

At the delivery end of the extrusion nozzle 24, there is another die assembly 46 having convoluted die elements 48 and 50 for compressing and interlocking the two extruded paste materials A and B into a composite extrusion, after which the composite extrusion can be cut and finished into dual composition bars as illustrated in FIG. 2 and indicated generally at 60.

The dual composition bar 60 is extruded from two different paste materials forming bar portions 62 and 64. The bar 60 has its upper surface provided with convolutions 66 shown as a substantially sinusoidal configuration for enhancing the scrubbing action of the bar 60 against the surface to be scrubbed. Similarly, the bottom surface of the bar 60 has a convoluted configuration at 65 generally of sinusoidal shape for enhancing scrubbing action. A multiple tongue and groove interlock 67 is formed during the extrusion process, which is enhanced by the extrusion of the convoluted surfaces 66 and 65 during extrusion by forcing the tongue and groove interlock when passing through the die 46.

The dual compositions for the bar can be as follows:

(A) Detergent or soap or (B) Fabric or skin softening compound (A) One color detergent or (B) Second color detergent (A) One material or (B) Second material incompatible to the first (A)

Further, (A) and (B) can be of different ratios, such as 80% of (A) and 20% of (B), by varying the feed rates of the two streams.

The following are examples of formulas employed:

EXAMPLE I (A) 50% Blue Color: 18% Alkyl benzene sulfonate; 15% Cornstarch; 11% Bentonite; 3% Glycerine; 25% Calcite; 10% Soda Ash, Q.S. Blue Color+Titanium dioxide+Water.

(B) 50% Pink Color: 18% Alkyl benzene sulfonate; 15% Cornstarch; 11% Bentonite; 3% Glycerine; 25% Calcite; 10% Soda Ash, Pink Color+Titanium dioxide+Water.

EXAMPLE II (A) 80% Blue Color-Detergent: 30% Alkyl benzene sulfonate; 15% Bentonite; 30% Calcite; 10% Soda Ash, Q.S. Blue Color+Titanium dioxide+Water.

(B) 20% Pink Color: 10% Alkyl benzene sulfonate; 15% Cornstarch; 15% Softening clay; 3% Soap; 3% Glycerine Pink Color+Titanium dioxide+Water.

During the actual usage in the shower or wash basin, the consumer switches to the side preferred for a specific function, i.e., after washing first with the side (A), one can switch the sides and hold side (A) to wash with side (B) to provide the final rinse, softening, perfuming, etc.

Also, by keeping the two formulas separate, there now can be formulated incompatible ingredients into the same bar, such as fatty acids which, if incorporated with the detergent materials, can hinder the performance of the total bar. However, by the present invention the common product (two products in one, actually) can still be produced, but which can still preserve the benefits and functionalities of both materials. Other examples of incompatible materials and soap and moisturizers, anionics and cationics, high pH and high pH unstable materials, etc. An example of this would be a high pH detergent bar on one side and a pH-sensitive alpha sulfo methyl ester on the other side.

What is claimed is:

1. A dual composition soap or detergent bar comprising two separately extruded bar portions of different compositions, said bar including a convoluted upper and a convoluted lower surface and a tongue and groove interlock between said bar portions, said tongue and groove interlock including a plurality of tongues and grooves in each of said bar portions, said convolutions in said upper and lower surfaces being sinusoidal in configuration, said bar portions being co-extruded and pressed together compressing said bar portions together forcing said tongues and grooves to interlock.

2. A dual composition soap or detergent bar comprising two bar portions of different compositions, said bar including a convoluted upper and a convoluted lower surface and a tongue and groove interlock between said bar portions, said tongue and groove interlock including a plurality of tongues and grooves in each of said bar portions, said convolutions in said upper and lower surfaces being sinusoidal in configuration, said bar portions being separately extruded and thereafter being co-extruded through a die to firmly press said tongues into said grooves for firmly locking said bar portions together.

* * * * *